United States Patent [19]

Pier-Amory et al.

[11] 3,969,982

[45] July 20, 1976

[54] APPARATUS FOR DAMPING THE FORWARD AND RETURN MOVEMENTS OF AN AUTOMATIC FIRING WEAPON

[75] Inventors: Jacques Pier-Amory, Chatelaine; Beat Koch, Hunibach, both of Switzerland

[73] Assignee: Werkzeugmaschinenfabrik Oerlikon-Bührle AG, Zurich, Switzerland

[22] Filed: Apr. 15, 1974

[21] Appl. No.: 461,119

[30] Foreign Application Priority Data

May 4, 1973 Switzerland ..... 6337/73

[52] U.S. Cl. ..... 89/178; 89/37 GM; 89/44 R

[51] Int. Cl.[2] ..... F41F 19/12

[58] Field of Search ..... 89/44 R, 44 A, 37 GM, 89/177, 178

[56] References Cited

UNITED STATES PATENTS 2,539,275 1/1951 Sahlin et al. ..... 89/44

3,662,648 5/1972 Maillard ..... 89/44 A

*Primary Examiner*—Stephen C. Bentley

*Attorney, Agent, or Firm*—Werner W. Kleeman

[57] ABSTRACT

An apparatus for damping the forward and return motion of an automatic firing weapon comprising a weapon mount, a weapon housing and a weapon barrel, movement of the weapon housing is dampened with respect to the weapon mount by a first annular spring, which annular spring is arranged in a damping mechanism externally of the weapon housing. The weapon barrel is displaceably arranged with respect to the weapon housing and the movement of the weapon barrel with respect to the weapon housing is dampened by a second annular spring, and the second annular spring is arranged in the aforesaid damping mechanism.

13 Claims, 4 Drawing Figures

APPARATUS FOR DAMPING THE FORWARD AND RETURN MOVEMENTS OF AN AUTOMATIC FIRING WEAPON

BACKGROUND OF THE INVENTION

The present invention relates to a new and improved construction of apparatus for damping the forward and return or recoil motion of an automatic firing weapon, comprising a gun or weapon mount, a weapon housing and a weapon barrel, wherein movement of the weapon housing with respect to a stationary weapon mount is dampened by an annular spring, which annular spring is arranged in a damping mechanism externally of the weapon housing.

According to a known apparatus of this type only the weapon housing is displaceable relative to the weapon or gun mount. With such apparatus the weapon barrel is rigidly secured to the weapon housing.

SUMMARY OF THE INVENTION

It is a primary object of the present invention to provide an improved construction of apparatus for damping the forward and return movement of an automatic firing weapon by means of which both the movement of the weapon housing with regard to the weapon mount as well as also the movement of the weapon barrel with respect to the weapon housing can be damped in order, on the one hand, to absorb as intensively as possible the recoil forces and, on the other hand, during series firing to accommodate as favorably as possible to one another the course of the movement of the weapon housing and the weapon barrel.

Now in order to implement this object and others which will become more readily apparent as the description proceeds, the inventive apparatus is manifested by the features that the weapon barrel is displaceably arranged with respect to the weapon housing and the movement of the weapon barrel with regard to the weapon housing is damped by a second annular spring, this second annular spring is arranged in the aforementioned damping mechanism.

BRIEF DESCRIPTION OF THE DRAWINGS

The invention will be better understood and objects other than those set forth above, will become apparent when consideration is given to the following detailed description thereof. Such description makes reference to the annexed drawings illustrating two exemplary embodiments of the invention, and wherein.

DETAILED DESCRIPTION OF THE PREFERRED EMBODIMENTS

Figure 1:
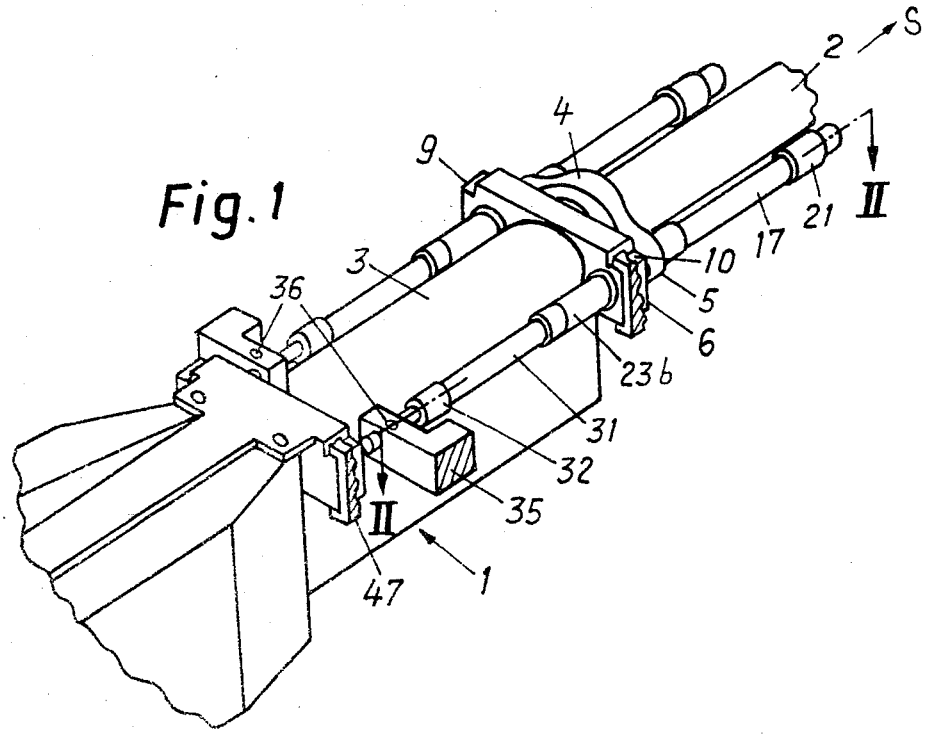
FIG. 1 is a front view of a firing weapon with a recoil or return motion device according to a first exemplary embodiment of the invention and shown in perspective view.

Describing now the drawings, according to the showing of FIG. 1 the firing weapon encompasses a housing 1 and a weapon or gun barrel 2. The housing 1 is displaceably mounted with regard to a weapon mount balance or rocker 35. In FIG. 1 only part of the weapon or gun mount balance 35 has been shown in order to preserve clarity in illustration. The barrel 2 is displaceably mounted in a sleeve-shaped portion 3 of the weapon or gun housing 1. A yoke 4 is fixedly seated forwardly of the housing 1 at the barrel 2. This yoke 4 possesses a pair of projections 5 and the housing 1 two pairs of projections 6. The projections 5 and 6 extend towards the outside to both sides of the weapon or gun barrel 2 and the housing 1. The projections 5 and the pair of projections 6 situated closer thereto possess coaxial bores 7 and 8 which are directed essentially parallel to the axis of the gun barrel 2, as best seen by referring to FIG. 2. Machined e.g. by milling at the projections 6 are surfaces 9 which are parallel to the longitudinal or lengthwise extending central plane of the housing 1 and surfaces 10 which are directed perpendicular to these surfaces 9. The projections 6 of the housing 1 are guided in rails 47, which in the showing of FIG. 1 have been conveniently shown at one side of the weapon and connected with a part of the weapon mount balance 35 which has not been particularly shown in the drawings.

Figure 3:
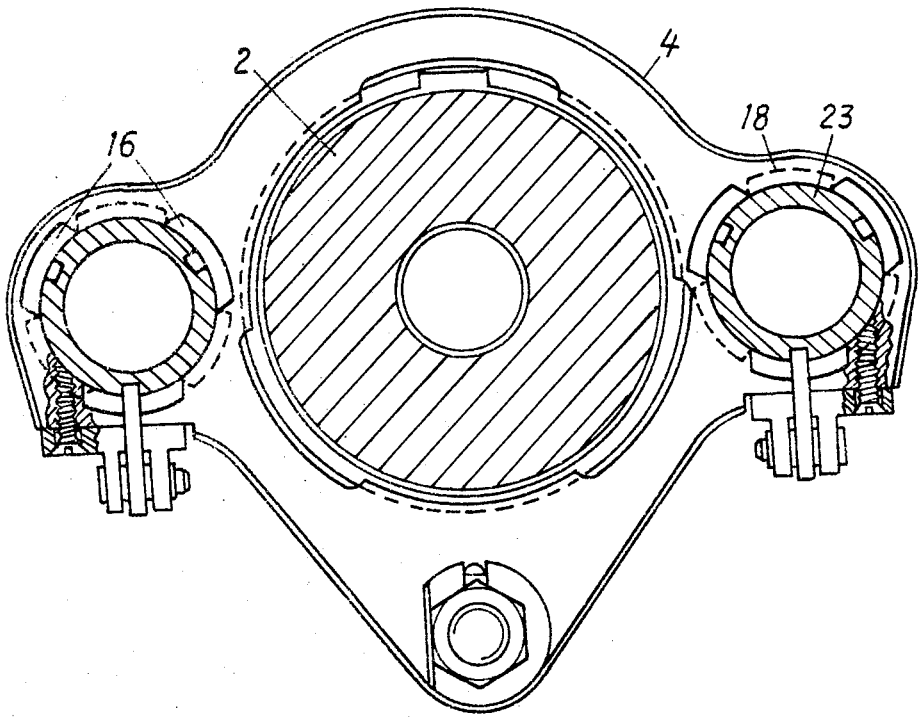
FIG. 3 is a cross-sectional view, taken substantially along line III—III of FIG. 2.
Figure 2:
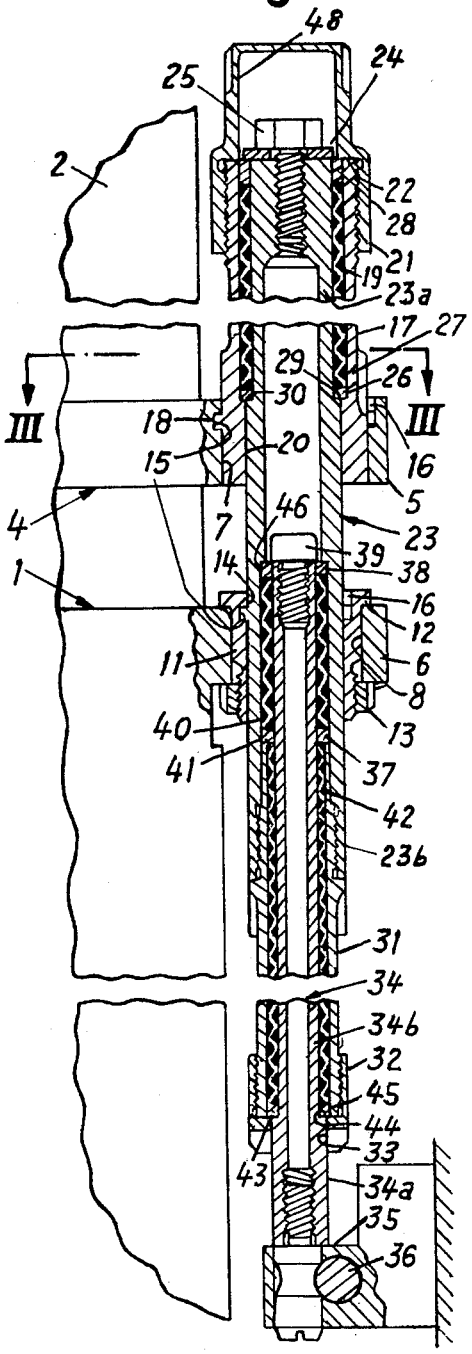
FIG. 2 is a cross-sectional view, taken substantially along line II—II of FIG. 1.

According to the showing of FIG. 2 a bushing 11 is inserted in the bore 8 of each projection 6 of the housing 1. This bushing 11 is positionally secured by a flange 12 and a counter nut member 13 which is threaded on to the bushing 11 as shown. In the bore 14 of the bushing 11 and the bore 7 of the associated projection 5 at the yoke 4 there are suitably machined coaxial grooves or recesses 15. The grooves 15 are open towards the front ends by three sector-shaped outputs or recesses 16, as best seen by referring to FIG. 3. In bore 7 of each yoke projection 5 there is mounted a sleeve 17. This sleeve 17 is secured by bayonet joints e.g. by bayonet tabs or projections 18 of the sleeve 17, which are introduced via the cutouts or recesses 16 into the grooves 15. The sleeve 17 extends away from the yoke 4 towards the front in the firing direction S and possesses two bore portions 19, 20. The diameter of the forward bore portion 19 of sleeve 17 is somewhat larger than that of the rear bore portion 20. A retaining or clamping nut 21 is threaded onto the sleeve 17 and bears by means of a shoulder 22 at the end surface thereof. The nut member 21 possesses a bore 48, the diameter of which is smaller than the diameter of the bore portion 19.

In the bore 14 of the bushing 11 there is mounted a sleeve 23 with its sleeve part 23*b*, which is secured by bayonet joints e.g. bayonet projections or tabs 18 of the sleeve 23 which engage with the grooves 15 of bushing 11. The sleeve 23 extends into the sleeve 17 and is displaceably mounted in its bore portion 20. A part 23*a* of the sleeve 23, which is located essentially at the bore portion 19 of the sleeve 17, possesses an external diameter which is smaller than the diameter of the bore portion 19. A support disk 24 is held in contact with the end surface of the sleeve portion 23*a* by means of the head 25 of the illustrated screw (FIG. 2) which is threaded into such sleeve portion 23*a*, as shown. The support disk 24 possesses a larger diameter than the outer diameter of the sleeve portion 23*a*.

The sleeve portion 23*b* is threadably connected with a further sleeve 31. The diameter of the bore of the sleeve portion 23*b* is larger than the bore diameter of the sleeve 31. A retaining nut member 32 equipped with a central bore 33 is threaded onto the sleeve 31. The diameter of the bore 33 is smaller than the diameter of the bore of the sleeve 31. A rod 34 is arranged in the sleeves 23*b*, 31 or sleeve portions coaxial thereto. A part 34*a* of rod 34 extends through the bore 33 out of the sleeve 31. This rod portion or part 34*a* is mounted at a part of the gun mount balance or rocker 35 and is fixedly connected therewith by a bolt 36. The diameter of the rod portion 34*b* which is located in the sleeve 31 is smaller than that of the rod portion 34*a*. The end of the rod portion 34*b* is displaceably supported upon two ring members 37 and 38 which are displaceably mounted in the bore of the sleeve portion 23*b*. The cylindrical head 39 of a screw, which has not been particularly designated, threaded into the end of the rod portion 34*b* and supported at the end surface thereof possesses a diameter which is larger than the diameter of the rod portion 34*b*.

A first annular or circular spring is subdivided into two spring sets or packages 40, 42. The one set of springs 40 is arranged between both rings or ring members 37 and 38. By means of the spring set 40 the ring 37 is pressed against the end surface 41 of the sleeve 31 and the ring 38 against the screw head 39. The other set or package of springs 42 is arranged between the ring member 37 and ring member 43, which bears against a shoulder 44 of the rod 34. The set of springs 40, 42 and the ring member 37 are displaceable upon the rod 34. A shoulder 45 of the retaining nut member 32 bears against the ring 43 and a shoulder 46 of the sleeve 23 bears against the ring or ring member 38, thereby fixing the rest position of the housing 1 with regard to the mount balance or rocker 35.

A ring member 26, a second annular or circular spring 27 and a ring member 28 are displaceably arranged behind one another at the sleeve portion or part 23*a*. Under the pre-bias force of the second annular spring 27 the ring or ring member 26 bears against a shoulder 29 of the sleeve 23 and the ring member 28 bears against the supporting disk 24. Shoulder 30 of the sleeve 17 bears against the ring member 26 and shoulder 22 of the retaining nut member 21 bears against the ring member 28, thereby fixing the rest position of the barrel 2 with regard to the housing 1.

Having had the benefit of the foregoing description of the construction of the apparatus of this development its mode of operation will now be described and is as follows:

Under the action of a recoil force, which during firing of the weapon loads the barrel 2, the latter together with the yoke 4, the sleeve 17 and the retaining nut member 21 carries out a movement which is opposite to the direction of firing S with respect to the weapon housing 1. Consequently, the yoke 4 approaches the weapon housing 1, and the sleeve 17 is thus displaced upon the sleeve 23 and the second annular spring 27 is compressed together. By means of the second annular spring 27 the recoil force is transmitted to the sleeve 23 and the weapon housing 1 which is connected therewith and such components likewise carry out a movement which is directed opposite to the direction of firing S with respect to the stationary rod 34. During this motion the tandemly arranged sets of springs 40, 42 of the first annular or circular spring are compressed together. Since the line of action of the reaction force which is exerted by such first annular springs 40, 42 upon the sleeve 23 coincides with the line of action of the force of the second annular spring 27, the weapon housing 1 is therefore not additionally loaded by bending moments due to the recoil of the barrel 2. Furthermore, since the force of the second annular spring 27 is transmitted via the sleeve 23 directly to the first annular springs 40, 42, the weapon housing 1, during recoil or return motion of the barrel 2, is not loaded by compression forces.

Figure 4:
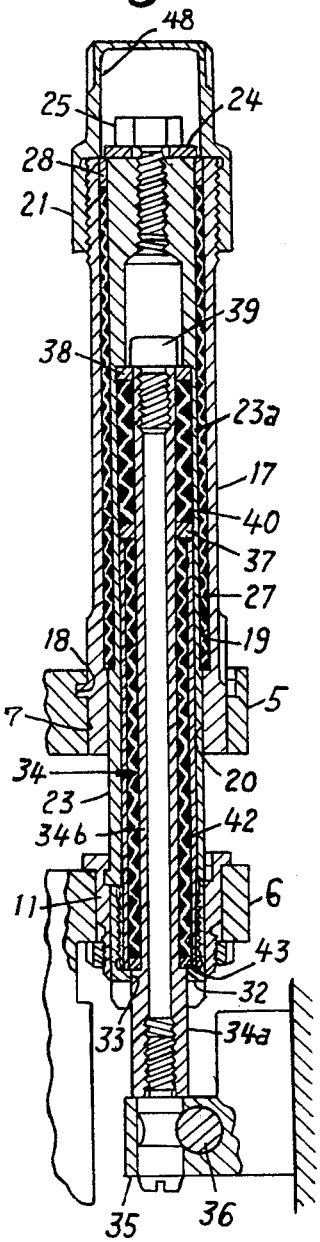
FIG. 4 is a sectional view corresponding to the showing of FIG. 2 of a further exemplary embodiment of recoil mechanism.

In contrast to the arrangement according to FIGS. 1 and 2 in which the annular or circular springs 27 and 40, 42 are tandemly arranged, i.e. behind one another, with the modified version of apparatus depicted in FIG. 4, wherein the same reference characters have been generally used for the same or analogous components, the annular springs 40, 42 of the weapon housing 1 are arranged partially within the sleeve 17, in other words, concentrically with regard to the annular spring 27 of the barrel 2. The advantage of this arrangement resides in the shorter constructional length with regard to that shown in FIGS. 1 and 2. However, the mode of operation of the apparatus according to this modified second exemplary embodiment is not different from that described above with regard to the first exemplary embodiment.

While there is shown and described present preferred embodiments of the invention, it is to be distinctly understood that the invention is not limited thereto, but may be otherwise variously embodied and practiced within the scope of the following claims.

Accordingly, what is claimed is:

1. An apparatus for damping the forward and return movements of an automatic firing weapon comprising a stationary weapon mount, a weapon housing and a weapon barrel, a first annular spring for damping movement of the weapon housing with respect to the stationary weapon mount, said annular spring being arranged externally of the weapon housing in a damping mechanism, means for displaceably arranging the weapon barrel with respect to the weapon housing, a second annular spring for damping the movement of the weapon barrel with respect to the weapon housing, said second annular spring being arranged in said damping mechanism, said damping mechanism comprising a first sleeve member secured at the weapon housing substantially parallel to the weapon barrel, said sleeve member being supported via the first annular spring at the stationary weapon mount, the weapon barrel being supported at the sleeve member via the second annular spring, a further sleeve member, said two sleeve members being arranged parallel to and at both sides of the weapon barrel and provided at the weapon housing.

2. An apparatus for damping the forward and return movements of an automatic firing weapon comprising a stationary weapon mount, a weapon housing and a weapon barrel, a first annular spring for damping movement of the weapon housing with respect to the stationary weapon mount, said annular spring being arranged externally of the weapon housing in a damping mechanism, means for displaceably arranging the weapon barrel with respect to the weapon housing, a second annular spring for damping the movement of the weapon barrel with respect to the weapon housing, said second annular spring being arranged in said damping mechanism, said damping mechanism comprising a first sleeve member secured at the weapon housing substantially parallel to the weapon barrel, said sleeve member being supported via the first annular spring at the stationary weapon mount, the weapon barrel being supported at the sleeve member via the second annular spring, and wherein the first and second annular springs are coaxially arranged within one another with regard to the sleeve member.

3. An apparatus for damping the forward and return movements of an automatic firing weapon comprising a stationary weapon mount, a weapon housing and a weapon barrel, a first annular spring for damping movement of the weapon housing with respect to the stationary weapon mount, said annular spring being arranged externally of the weapon housing in a damping mechanism, means for displaceably arranging the weapon barrel with respect to the weapon housing, a second annular spring for damping the movement of the weapon barrel with respect to the weapon housing, said second annular spring being arranged in said damping mechanism, said damping mechanism comprising a first sleeve member secured at the weapon housing substantially parallel to the weapon barrel, said sleeve member being supported via the first annular spring at the stationary weapon mount, the weapon barrel being supported at the sleeve member via the second annular spring, said sleeve member defines a first sleeve member, a second sleeve member secured to the weapon barrel, said second sleeve member surrounding a portion of the first sleeve member, and a third sleeve member secured to the weapon mount, said third sleeve member extending into another portion of the first sleeve member, the first annular spring being located between the first and third sleeve members, said first annular spring bearing with one end at the first sleeve member and with its other end at the third sleeve member, and wherein the second annular spring is arranged between the first and second sleeve members, said second annular spring bearing with one end at the first sleeve member and with its other end at the second sleeve member.

4. The apparatus as defined in claim 3, wherein the first and second sleeve members are detachably secured by quickly releasable connection means at the weapon barrel and the weapon housing respectively.

5. The apparatus as defined in claim 3, wherein the first and the second sleeve members possess shoulders which are directed towards one another and arranged in spaced relationship from one another, said second annular spring being pre-stressed between said shoulders in order that the second annular spring acts in a damping manner both during forward movement as well as also during return movement of the weapon barrel with regard to the weapon housing.

6. The apparatus as defined in claim 3, wherein the first and third sleeve members possess shoulders directed towards one another and arranged in spaced relationship from one another, the first annular spring being pre-stressed between said shoulders in order that the first annular spring acts in a damping manner both during the forward movement as well as during the return movement of the weapon housing with regard to the stationary weapon mount.

7. The apparatus as defined in claim 3, wherein there are provided two of said second sleeve members arranged in parallelism with respect to one another, each of said second sleeve members being arranged to one side of the weapon barrel and being secured at the weapon barrel via a yoke.

8. The apparatus as defined in claim 3, wherein there are provided two of said third sleeve members arranged in parallelism with respect to one another at opposite sides of the weapon mount, and means for securing said third sleeve members to said weapon mount.

9. An apparatus for damping the forward and return movements of an automatic firing weapon comprising a stationary weapon mount, a weapon housing and a weapon barrel, a first annular spring for damping movement of the weapon housing with respect to the stationary weapon mount, said annular spring being arranged externally of the weapon housing in a damping mechanism, means for displaceably arranging the weapon barrel with respect to the weapon housing, a second annular spring for damping the movement of the weapon barrel with respect to the weapon housing, said second annular spring being arranged in said damping mechanism, the first annular spring is subdivided into two sets of springs, between which sets of springs there is arranged a ring member in such a manner that upon return movement of the weapon housing both sets of springs are compressed, whereas during the forward movement only one set of springs is compressed.

10. The apparatus as defined in claim 9, wherein the first and second annular springs are coaxially arranged behind one another with regard to the sleeve member.

11. An automatic firing weapon comprising a weapon mount, a weapon housing and a weapon barrel, a component displaceable relative to the weapon mount, said weapon housing being arranged at said component, a first spring element, said displaceable component bearing through the agency of said first spring element at the weapon mount, means for displaceably arranging the weapon barrel with respect to the weapon housing, a second spring element, the weapon barrel bearing via said second spring element at the displaceable component, said displaceable component comprising a sleeve member arranged along an axis laterally spaced from the weapon housing axis and the weapon barrel axis, the first spring element and the second spring element being substantially coaxially arranged with respect to said sleeve member.

12. The automatic firing weapon as defined in claim 11, wherein both spring elements comprise annular springs acting as damping elements.

13. The automatic firing weapon as defined in claim 12, wherein both annular springs are coaxially arranged behind one another with regard to the sleeve member.

* * * * *